US006881026B2

(12) United States Patent
Lifson et al.

(10) Patent No.: US 6,881,026 B2
(45) Date of Patent: Apr. 19, 2005

(54) SCREW COMPRESSORS WITH ROTOR AND CASING DESIGN FOR CONTROLLING DEFLECTIONS

(75) Inventors: Alexander Lifson, Manlius, NY (US); James William Bush, Skaneateles, NY (US); Mark Daniels, Manlius, NY (US); Reng Lin, Manlius, NY (US); William Rousseau, Manlius, NY (US); Tim Wagner, East Hartford, CT (US); Donald Yannoscoli, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/023,491

(22) Filed: Dec. 18, 2001

(65) Prior Publication Data

US 2003/0113202 A1 Jun. 19, 2003

(51) Int. Cl.[7] ..... F04D 29/32; F04D 29/38

(52) U.S. Cl. ..... 415/72; 415/176; 415/177; 415/178; 416/176; 416/177

(58) Field of Search ..... 415/72, 73, 74, 415/75, 175–178; 416/176, 177

(56) References Cited

FOREIGN PATENT DOCUMENTS

JP 3-78594 A * 4/1991 ..... 415/73

* cited by examiner

*Primary Examiner*—Christopher Verdier
(74) *Attorney, Agent, or Firm*—Bachman & LaPointe

(57) ABSTRACT

A screw compressor includes a housing and a screw rotor disposed in the housing and rotatable relative to the housing for compressing a refrigerant, the housing and the screw rotor having a rest condition, and an operating condition wherein at least one of the housing and the rotor deflect from the rest condition, and structure for at least one of reducing deflection from the rest condition and evenly distributing deflection from the rest condition when the rotor is in the operating condition, whereby clearance between the housing and the rotor is optimized in the operating condition.

9 Claims, 4 Drawing Sheets

SCREW COMPRESSORS WITH ROTOR AND CASING DESIGN FOR CONTROLLING DEFLECTIONS

BACKGROUND OF THE INVENTION

Screw compressors are widely used in refrigeration and other environments, and involve screw rotors rotated within a housing or casing to compress refrigerant to obtain the desired objectives. Excessive clearance between screw rotors and the housing results in loss of efficiency, while insufficient clearance results in rubbing and potential failures due to scoring or excessive wear of compressor components.

Ideally, screw compressors would be provided having clearance of zero or as close to zero as possible along the entire rotor length, for all operating conditions of the compressor. Of course, it is impossible to achieve such zero clearance as different operating conditions subject the compressor to different stresses and forces which cause the clearance to vary across the rotor length.

The primary object of the present invention is to modify screw compressor design to reduce clearance along the rotor length and/or reduce clearance variations due to changes in operating conditions, particularly within an expected operating envelope, without compromising compressor reliability.

If clearance variations during compressor operation are reduced, then the compressor can be assembled having smaller clearances, while maintaining rub free operation throughout the operating envelope. It is a particular objective of the present invention to provide such reduction in clearance variations.

Other objects and advantages of the present invention will appear hereinbelow.

SUMMARY OF THE INVENTION

In accordance with the present invention, a screw compressor is provided which comprises a housing and a screw rotor disposed in said housing and rotatable relative to said housing for compressing a refrigerant, said housing and said screw rotor having a rest condition, and an operating condition wherein at least one of said housing and said rotor deflect from said rest condition, and means for at least one of reducing deflection from said rest condition and evenly distributing deflection from said rest condition when said rotor is in said operating condition, whereby clearance distribution between said housing and said rotor is optimized in said operating condition.

In accordance with one aspect of the invention, the screw rotor pressure load distribution is modified so as to provide a resultant load due to operation of the compressor which is smaller in magnitude and which act on said rotor at a point closer to the discharge end bearing. This helps to reduce deflection of compressor components so as to minimize variation in clearance during compressor operation in accordance with the present invention.

In accordance with a further aspect of the present invention, the suction end of the rotor is adapted to be more flexible than the discharge end, preferably by providing the suction end of the rotor or rotor shaft in hollow form such that the smaller load at this portion of the shaft will produce substantially the same amount of deflection or distortion as is provided by the larger load at the discharge pressure end, which is applied to a solid rotor end shaft. This advantageously evens out deflection due to operation within the expected operating envelope, further facilitating minimization of variation in clearance in the operating envelope.

In accordance with another aspect of the present invention, additional thermal masses are positioned at desirable locations, particularly on the compressor housing, so as to reduce thermal distortions of compressor components or provide for thermal distributions that will compensate for load deflections, thus reducing clearance and variance in clearance.

BRIEF DESCRIPTION OF THE DRAWINGS

A detailed description of preferred embodiments of the present invention follows, with reference to the attached drawings, wherein.

DETAILED DESCRIPTION

The invention relates to screw compressors and, more particularly, to modification of screw compressors for reducing variance in clearance between compressor components, especially in an expected operating envelope. In addition to reducing clearance variance, the designer may modify screw compressor design such that the compressor operates with smallest clearances at high pressure ratio operating conditions where effects of clearance on performance are the most important.

As is well known, screw compressors operate to compress refrigerant and involve screw rotors rotating within a housing and fed with refrigerant which is compressed as it travels along the length of the rotors. During operation, potentially large pressures and forces are generated and exerted against the rotor and housing of screw compressors, and thermal distortions are also experienced. Such pressure loading and thermal distortion result in undesirable flexing of components so as to provide for variation in clearance between the operating and rest conditions of the compressor components. This can adversely affect efficiency and, in extreme cases, cause premature wear and failure of the compressor.

In accordance with the present invention, distortion is reduced and/or more uniformly distributed so as to allow design of compressors which have minimal clearance and variation in clearance at least within a desired operating envelope. Compressors can therefore be provided which will deflect from a rest condition during use, and the deflection can be controlled according to the invention so as to provide substantially constant and reduced clearance in the operating condition or envelope.

Figure 1:
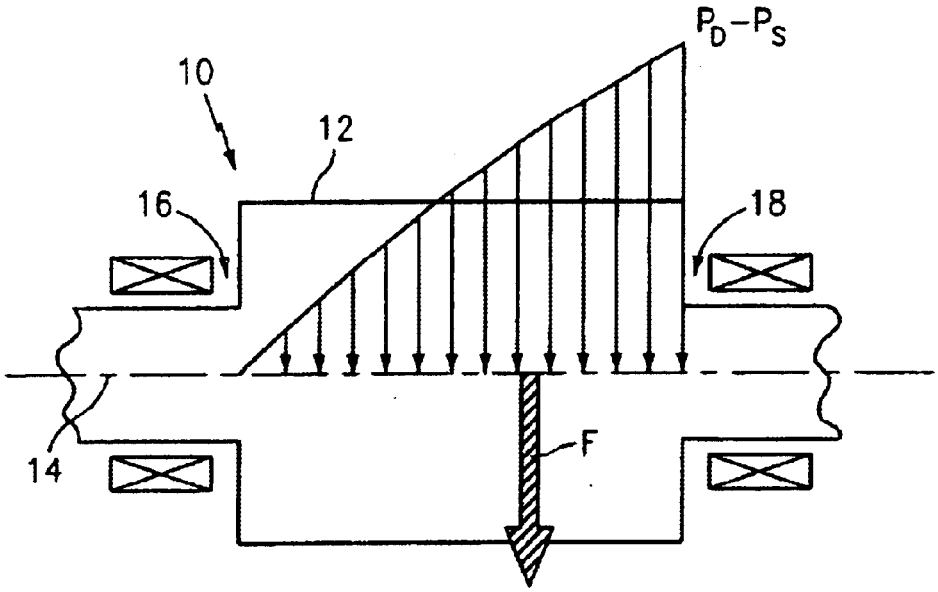
FIG. 1 (PRIOR ART)
FIG. 1 illustrates a pressure load distribution for a conventional screw rotor.

FIG. 1 schematically shows a portion of a compressor 10, more particularly a rotor 12, and shows a pressure load distribution on same, determined as the difference between discharge pressure ($P_D$) minus suction pressure ($P_s$). This pressure load distribution is shown as experienced by a conventional rotor along the rotor length from the suction end 16 to the discharge end 18. Although details of the rotor are not shown, the rotor would be positioned along axis 14 and rotated so as to operate as desired and create the pressure load distribution as shown. A conventional screw rotor has lobes arranged in a uniform pitch, and refrigerant fed to the compressor at suction end 16 is compressed and generates the pressure load distribution as shown, providing a final pressure differential at discharge end 18. This results in a resultant load or force (F) on a rotor 12 which causes substantial distortion of rotor 12.

In accordance with the present invention, the pressure load distribution is modified, while nevertheless resulting in substantially the same mass flow and power draw, so as to provide a smaller resultant load, and/or a resultant load which is effectively applied at a point along the rotor which is closer to the discharge end bearing.

The advantageous pressure load distribution in accordance with the present invention may be accomplished by altering screw rotor geometry, or by operating unloaders of the screw compressor, or through combinations of these techniques or in other manners as well.

Figure 2:
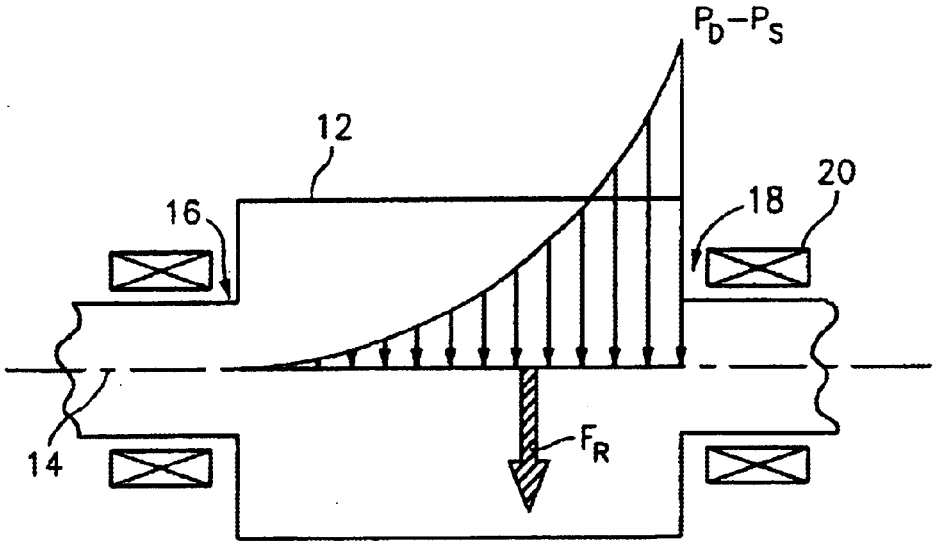
FIG. 2 illustrates a pressure load distribution for a screw rotor in accordance with the present invention.

FIG. 2 shows rotor 12 having a modified pressure loading which provides a reduced resultant force ($F_R$) which is smaller than the force conventionally generated and which is applied more closely to a discharge end bearing 20 of rotor 12.

Figure 8:
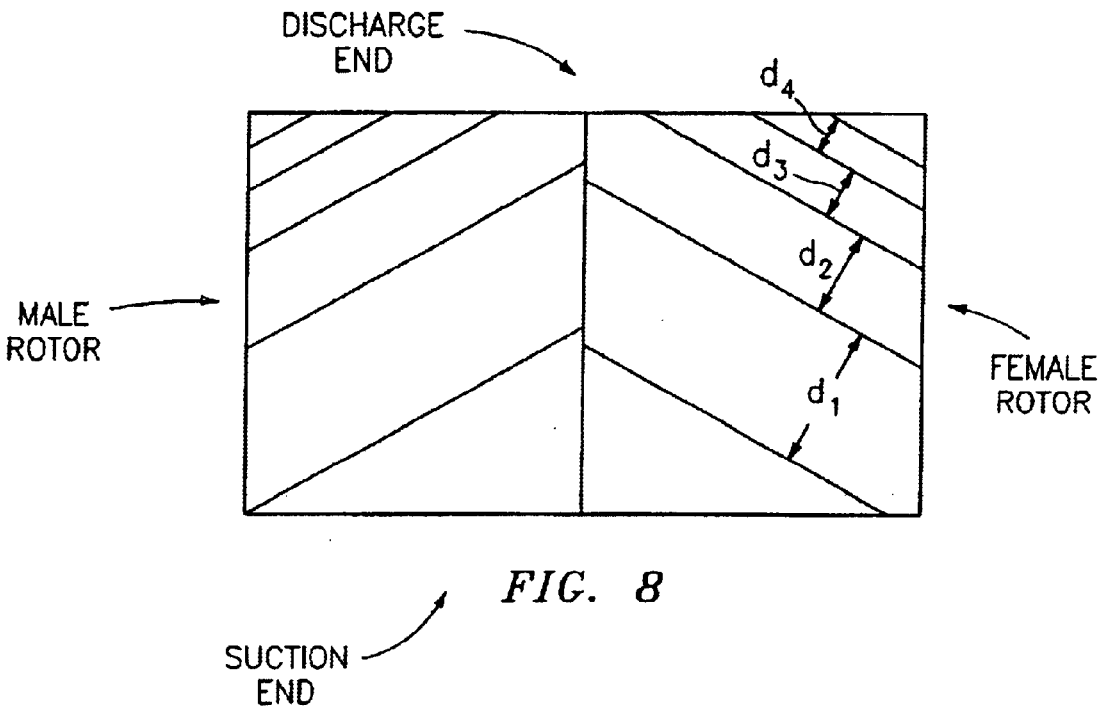
FIG. 8 shows a rotor with decreasing pitch magnitude.

The screw rotor profile geometry modification in accordance with one aspect of the present invention is to modify the pitch between lobes of the screw rotor so as to provide a screw rotor having a large pitch at the suction end 16, with this pitch decreasing in a direction toward discharge end 18 of the rotor (see FIG. 8.). This results in the greatest amount of compression, and therefore the greatest load applied to the rotor, occurring at the discharge end of the rotor, and increasing more dramatically as opposed to the gradual buildup as shown in FIG. 1. This results in a pressure load distribution on the rotor which is smaller and which generates resultant force $F_R$ at a more desirable location than the pressure load distribution of a conventional rotor as illustrated in FIG. 1.

As shown in FIG. 2, reduced resultant force $F_R$ is located closer to discharge end bearings 20 which, in combination with the smaller magnitude of load, serve to reduce deflection of the rotor as desired.

In accordance with the present invention, a desirable pressure load distribution as shown FIG. 2 can also be accomplished, as mentioned above, through operation of compressor unloaders so as to introduce refrigerant at a point downstream from the suction end of the rotor.

Figure 3:
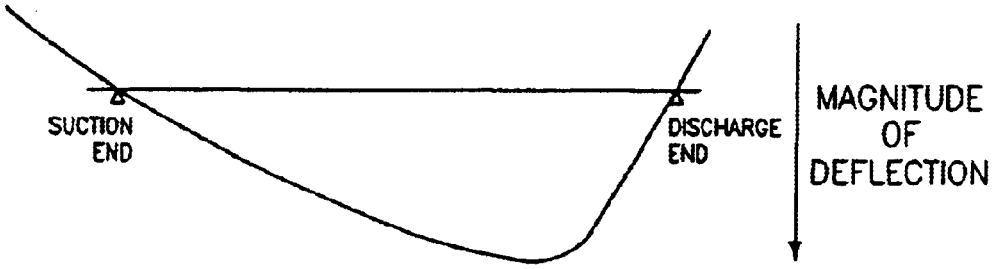
FIG. 3 (PRIOR ART)
FIG. 3 illustrates the magnitude of deflection of a conventional solid rotor when operated under typical conditions.

Turning to FIG. 3, a further problem overcome by the subject matter of the present invention is the uneven distribution of deflection caused by pressure load distribution on a conventional screw rotor. The gradually increasing pressure load distribution along the length of a rotor shaft results in gradually increasing shaft distortion from the suction end of the shaft toward a maximum shaft distortion which is skewed toward the discharge end, and then a sharp decrease in distortion over the last section of length of the shaft into the discharge end bearing. This distribution of distortion is schematically illustrated in FIG. 3, and causes difficulty in minimizing variation in clearance between the screw rotor and housing.

Figure 4:
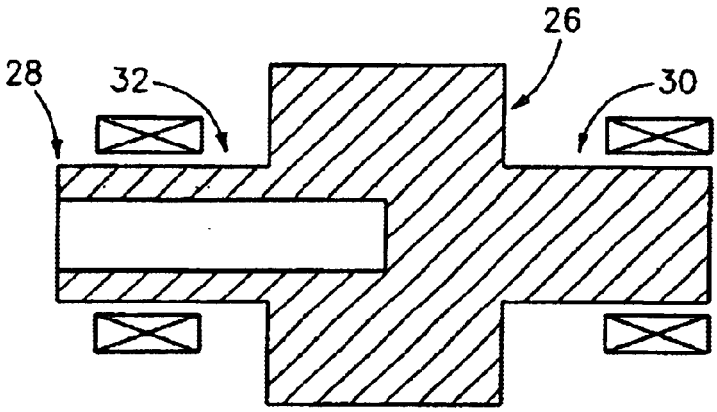
FIG. 4 illustrates an embodiment of a rotor in accordance with the present invention having a hollow shaft portion.

Turning to FIG. 4, a further aspect of the present invention is provided which readily resolves the issue illustrated in FIG. 3. FIG. 4 shows a schematic illustration of a rotor 26 having a suction end 28 and a discharge end 30. Rotor 26 is shown with lobes in greatly simplified detail so as to highlight the important features of the present invention. As shown, rotor 26 in accordance with the present invention is advantageously provided having a hollow portion 32 which is positioned at suction end 28 and extends along only a portion of rotor 26. The hollow portion 32 advantageously renders this portion of rotor 26 more flexible such that the uneven load distribution on the rotor nevertheless can result in an evened out displacement of the rotor, which advantageously facilitates minimizing of clearance variance between the rotor and the housing. The extent along the length of the rotor that hollow section 32 extends would depend upon the specific compressor structure and expected operating envelope. However, hollow section 32 should extend from suction end 28, and not through discharge end 30, so as to provide the desired evening out of deflection of rotor 26.

Figure 5:
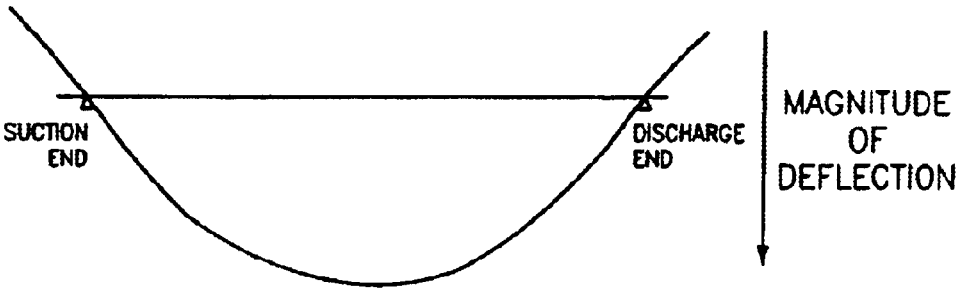
FIG. 5 illustrates deflection of a rotor in accordance with the present invention as illustrated in FIG. 4.

Turning to FIG. 5, a schematic illustration of rotor deflection is provided showing the more even distribution of rotor displacement which can be accomplished using a rotor in accordance with the present invention as illustrated in FIG. 4.

Figure 6:
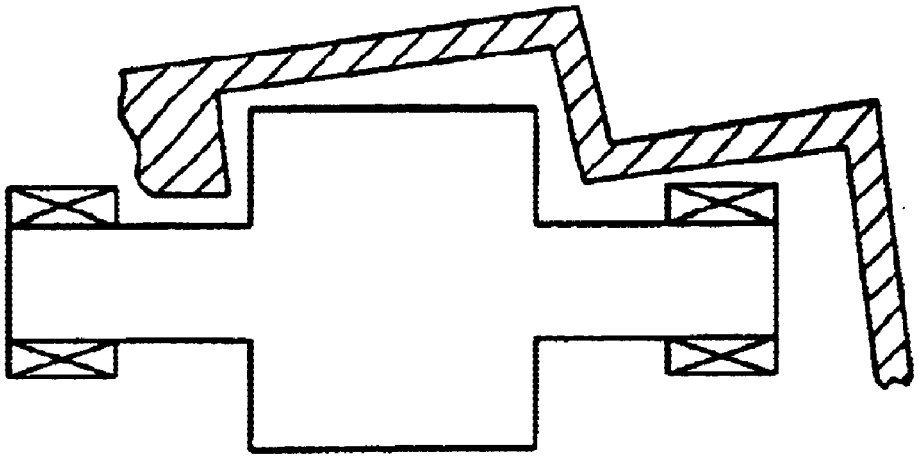
FIG. 6 (PRIOR ART)
FIG. 6 illustrates a typical casing distortion for a conventional compressor under applied pressure load and thermal distortion.

Turning now to FIG. 6, a further problem routinely encountered in connection with conventional screw compressors is illustrated. As a compressor is operated, in addition to the pressure loading discussed above, a substantial amount of heat is generated which tends to distort various components of the compressor. FIG. 6 shows a rough illustration of the typical end results, wherein the casing expands away from the rotor at the discharge end due to excess thermal distortions.

Figure 7:
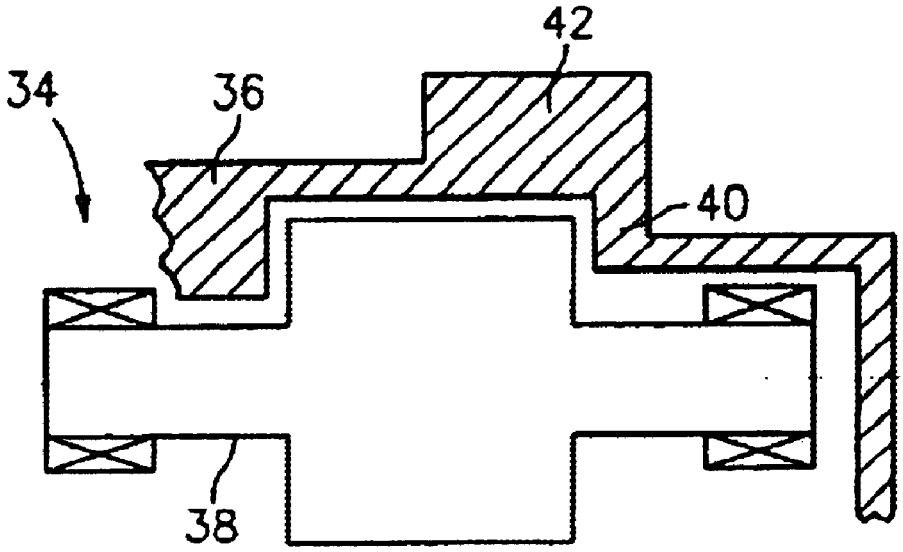
FIG. 7 illustrates a further embodiment of the present invention having an additional thermal mass for reducing thermal distortion, reinforcing the housing or compensating for pressure loads.

In accordance with the present invention, it has been found that such thermal distortions can be reduced or eliminated through positioning of additional thermal masses on the housing or casing. FIG. 7 shows a compressor 34 having a housing 36 and a rotor 38 schematically illustrated within housing 36 for rotation therein as desired. As demonstrated in FIG. 6, one point of excessive thermal distortion is at the discharge end shoulder or reduction in diameter of the housing, which tends to be subjected to a large amount of excess heat.

Returning to FIG. 7, this discharge end shoulder 40 is advantageously provided having an additional thermal mass 42 positioned so as to absorb heat generated by operation of the compressor and thereby reduce the actual temperature increase of the shoulder 40 and the resulting thermal distortion. Additional thermal mass 42 further advantageously serves to reinforce the discharge end of the casing to further resist distortion, for example the distortion due to applied pressure loading.

FIG. 7 shows additional thermal mass 42 as a thickening of the wall of housing 36 at the desired location. It should of course be appreciated that although this is a preferred location for an additional thermal mass, this mass could be provided in alternative manners, for example as a ring mounted around the outside of the housing rather than an integral portion of the housing, and thermal mass 42 could be positioned on different components such as rotor 38 and at different locations to address thermal distortion problems at other locations as well.

It should readily be appreciated that each of the aspects of the present invention as described above individually and in combination serves to reduce and/or evenly distribute distortion caused by operation of a screw compressor, all of which serves to facilitate design of a screw compressor which has substantially reduced clearance between components in the expected operating envelope as compared to the rest condition or the operating condition of conventional compressors. This represents a substantial improvement over conventional screw compressors, and allows for screw compressors to be provided which operate with greater efficiency and have enhanced operational life due to avoidance of excessive wear at points of insufficient clearance.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A screw compressor, comprising:

a housing; and a screw rotor disposed in said housing and rotatable relative to said housing for compressing a refrigerant, said housing and said screw rotor having a rest condition; and an operating condition wherein at least one of said housing and said rotor deflect from said rest condition, and means for at least one of reducing deflection from said rest condition and evenly distributing deflection from said rest condition when said rotor is in said operating condition, whereby clearance between said housing and said rotor is optimized in said operating condition; and wherein said rotor has a hollow section positioned along said rotor to substantially uniformly distribute deflection of said rotor in said operating condition over a length of said rotor.

2. The compressor of claim 1, wherein said means is selected from the group consisting of pressure influencing structures, temperature influencing structures and combinations thereof.

3. The compressor of claim 1, wherein said rotor has a suction end and a discharge end, and a profile geometry selected to provide a non-linear pressure loading from said suction end to said discharge end whereby a resultant load on said rotor is reduced.

4. The compressor of claim 3, wherein said rotor has a pitch which decreases in magnitude from said suction end to said discharge end.

5. The compressor of claim 4, wherein said resultant load is applied along said rotor at a point closer to said discharge end than said suction end.

6. The compressor of claim 1, wherein said rotor has a suction end and a discharge end, and wherein said hollow section is disposed at said suction end, whereby deflection of said rotor is beneficially distributed between said suction end and said discharge end.

7. The compressor of claim 1, further comprising an additional thermal mass positioned on at least one of said housing and said rotor so as to absorb heat generated by said compressor in said operating condition and reduce thermal distortion caused by said heat.

8. The compressor of claim 7, wherein said additional thermal mass comprises a section of additional wall thickness on said housing.

9. The compressor of claim 1, wherein said operating condition is an expected operating envelope for said compressor, and wherein said clearance is at least one of smaller and more evenly distributed in said operating condition than in said rest condition.

* * * * *